US006359530B1

(12) United States Patent
Grandchamp

(10) Patent No.: US 6,359,530 B1
(45) Date of Patent: Mar. 19, 2002

(54) SWITCHING WAVEGUIDE DIRECTIONAL COUPLER AND METHOD

(75) Inventor: Brett J. Grandchamp, Cumberland, ME (US)

(73) Assignee: General Signal Corporation, Muskegon, MI (US)

( * ) Notice: Subject to any disclaimer, the term of this patent is extended or adjusted under 35 U.S.C. 154(b) by 0 days.

(21) Appl. No.: 09/534,190

(22) Filed: Mar. 24, 2000

(51) Int. Cl.[7] ..... H01P 1/10; H01P 5/12
(52) U.S. Cl. ..... 333/108; 333/111
(58) Field of Search ..... 333/109, 105, 333/108, 111, 106; 348/50, 55, 47; 370/225

(56) References Cited

U.S. PATENT DOCUMENTS

| | | | | |
|---|---|---|---|---|
| 3,611,199 A | | 10/1971 | Safran | 333/10 |
| 3,659,227 A | | 4/1972 | Whistler | 333/7 |
| 4,119,931 A | | 10/1978 | Hudspeth et al. | 333/7 R |
| 4,491,871 A | * | 1/1985 | Schmitz et al. | 348/724 |
| 4,623,921 A | * | 11/1986 | Schmitz et al. | 348/485 |
| 4,701,724 A | | 10/1987 | Martin | 333/103 |
| 4,818,964 A | | 4/1989 | Wong | 333/111 |
| 5,148,507 A | | 9/1992 | Tanisawa | 385/41 |
| 5,699,465 A | | 12/1997 | Nakaya | 385/41 |
| 5,706,373 A | | 1/1998 | Mueller et al. | 385/14 |
| 5,778,306 A | | 7/1998 | Kommrusch | 455/78 |
| 5,786,912 A | | 7/1998 | Kartalopoulos | 359/117 |
| 5,832,148 A | | 11/1998 | Yariv | 385/16 |
| 5,841,912 A | | 11/1998 | Mueller-Fiedler et al. | 385/7 |
| 5,887,089 A | | 3/1999 | Deacon et al. | 385/22 |
| 6,069,529 A | * | 5/2000 | Evans | 330/124 D |

* cited by examiner

*Primary Examiner*—Justin P. Bettendorf
*Assistant Examiner*—Dean Takaoka
(74) *Attorney, Agent, or Firm*—Baker & Hostetler, L.L.P.

(57) ABSTRACT

A switchable directional coupler in which a three position switch partitions the coupler into three distinct coupling paths among its four ports according to the status of a pair of quadrature phase input signals of amplitudes A and B. In one position with both input signals being active, the output signal has an amplitude of A+B. In a second position with only the input signal of amplitude A being active, the output signal has an amplitude of A. In the third position with only the input signal of amplitude B being active, the output signal has an amplitude of B.

11 Claims, 5 Drawing Sheets

SWITCHING WAVEGUIDE DIRECTIONAL COUPLER AND METHOD

BACKGROUND OF THE INVENTION

1. Field of the Invention

This invention relates to directional couplers and, in particular, to a method and a directional coupler having a switch that provides selective coupling among the signal ports of the coupler.

2. Description of the Prior Art

Television signals are generated by power amplifiers and then combined in high frequency devices for delivery to a broadcast antenna. Should the output signal of any one power amplifier fail, it is extremely important that the remaining signal be delivered to the broadcast antenna with the highest available power.

When a directional coupler is used to combine television signals with amplitudes A and B, the amplitude of the output signal is A+B. For the typical case, A and B are substantially equal and the output signal amplitude is 2A. Should one of the signals fail, e.g., due to power amplifier failure, the remaining signal is coupled to the output port with an amplitude of A/2. To enhance the output signal amplitude to A, a switchless combiner has been used. A switchless combiner utilizes a directional coupler, a phase shifter and a magic-T connected in series. The switchless combiner is costly.

U.S. Pat. No. 4,119,931 discloses a parallel transmission line directional coupler with a switch that has a coupled and an uncoupled position. When in the uncoupled position, the switch isolates the parallel lines, and when in the coupled position, the switch electromagnetically couples the parallel lines.

An object of the present invention is to provide a switchable directional coupler that enhances output signal power without any need for a phase shifter or a magic-T.

SUMMARY OF THE INVENTION

A directional coupler according to the present invention has an electrical signal coupling enclosure with first, second, third and fourth ports. A switch has a first position that partitions the enclosure so that an output signal at the fourth port has an amplitude of A+B when input signals with amplitudes A and B are applied to the first and second ports. The switch has a second position that partitions the enclosure so that the output signal has an amplitude of A when only the first input signal is applied to the first port. The switch has a third position that partitions the enclosure so that the output signal has an amplitude of B when only the second input signal is applied to the second port.

The switch includes one or more shutters that are located to establish the first, second and third positions within the signal coupling enclosure. The shutters are slidably inserted and removed via channels disposed in the coupling enclosure.

BRIEF DESCRIPTION OF THE DRAWING

Other and further objects, advantages and features of the present invention will be understood by reference to the following specification in conjunction with the accompanying drawings, in which like reference characters denote like elements of structure and.

DESCRIPTION OF THE INVENTION

Figure 1:
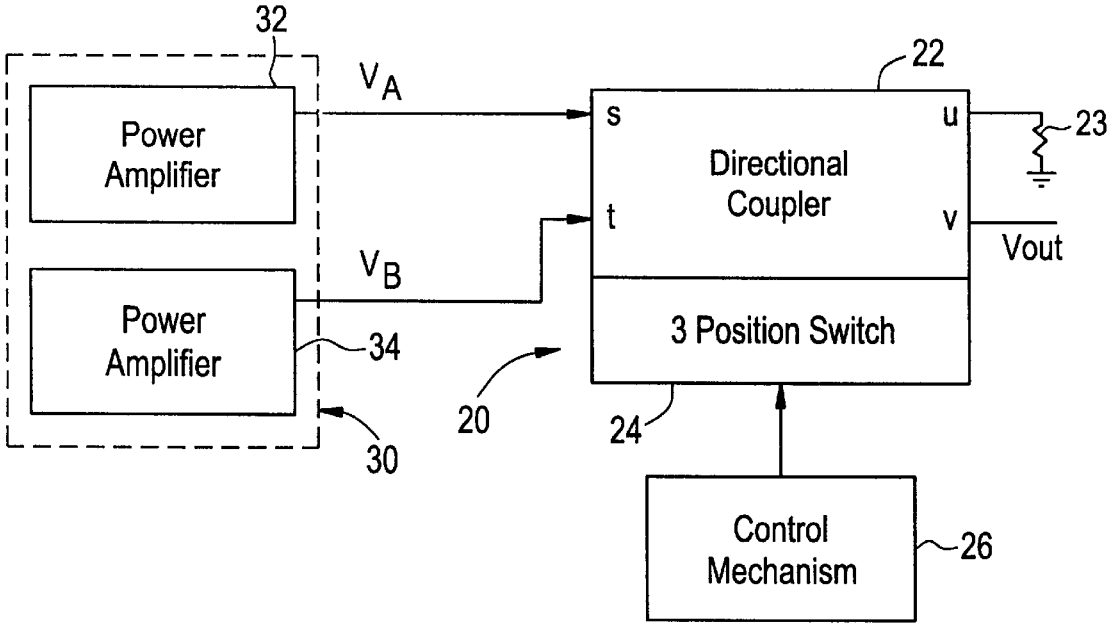
FIG. 1 is a block diagram of the switching directional coupler of the present invention interconnected with a broadcast system.

Referring to FIG. 1 a switching directional coupler 20 is shown connected in circuit with a broadcast system 30. Switching directional coupler 20 includes a directional coupler 22 with a three-position switch 24 that is driven by a control mechanism 26. Broadcast system 30 includes a pair of power amplifiers 32 and 34.

Directional coupler 22 has four ports s, t, u, and v, that correspond, respectively, to a first, second, third and fourth port. Port s receives a signal $V_A$ with amplitude A from power amplifier 32 and port t receives a signal $V_B$ with amplitude B from power amplifier 34. Port u is connected to a dummy load 23. An output signal Vout is developed at port v. The output signals of power amplifiers 32 and 34 are in quadrature phase. For example, $V_A$ has a phase of 0° and $V_B$ has a phase of −90°.

Figure 2:
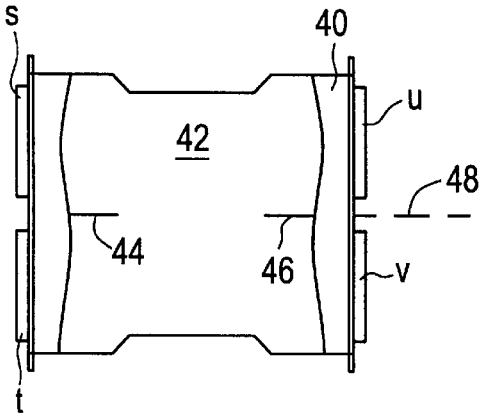
FIG. 2 is a plan view of the directional coupler of FIG. 1 with enclosure partially removed to depict a first switch position.
Figure 3:
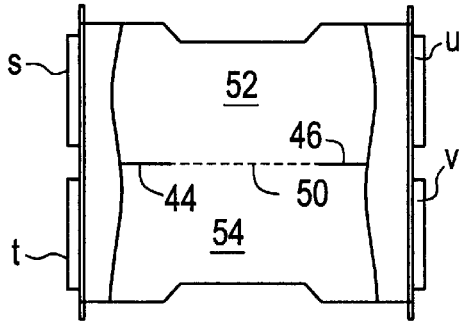
FIG. 3 is a plan view of the directional coupler of FIG. 1 with enclosure partially removed to depict a second switch position.
Figure 4:
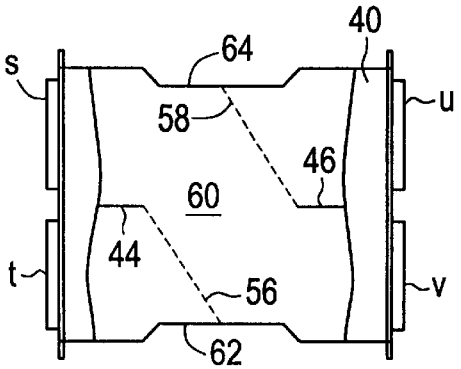
FIG. 4 is a plan view of the directional coupler of FIG. 1 with enclosure partially removed to depict a third switch position.

Switch 24 is operable to select three different partitions of the interior of directional coupler 22 according to the status of output signals $V_A$ and $V_B$ of power amplifiers 32 and 34. With reference to FIGS. 2 through 4, these three switchable partitions are shown for directional coupler 22. Directional coupler 22 has an enclosure 40 with an interior cavity 42. A portion of enclosure 40 is removed to show how switch 24 partitions interior cavity 42. A pair of panels 44 and 46 extends partially into interior cavity 42 along a centerline 48. Enclosure 40 and panels 44 and 46 are formed of metal, such as aluminum or copper.

FIG. 2 shows the partitioning of directional coupler 22 for the case where both $V_A$ and $V_B$ are active. The coupling among ports s, t, u and v is unrestricted. The amplitudes A and B of input signals $V_A$ and $V_B$ are additive at port v such that Vout has an amplitude of A+B.

FIG. 3 shows the partitioning of directional coupler 22 for the case where $V_A$ is failed or inactive and $V_B$ is active. For this position of switch 24, a shutter 50 connects panels 44 and 46 to partition interior cavity 42 into two separate coupling paths 52 and 54. The coupling of ports t and v is isolated from ports s and u. Signal $V_B$ is coupled from port t to port v such that Vout has an amplitude of B.

FIG. 4 shows the partitioning of directional coupler 22 for the case where $V_B$ is failed or inactive and $V_A$ is active. For this position of switch 24, a shutter 56 connects panel 44 to a sidewall 62 of enclosure 40 and a shutter 58 connects panel 46 to a sidewall 64 of enclosure 40. Shutters 56 and 58 partition interior cavity 42 into a coupling path 60 between ports s and v whereby the coupling of ports s and v is isolated from ports t and u. Signal $V_A$ is coupled from port s to port v such that Vout has an amplitude of A. Shutters 50, 56 and 58 are formed of metal, such as aluminum or copper.

Figure 5:
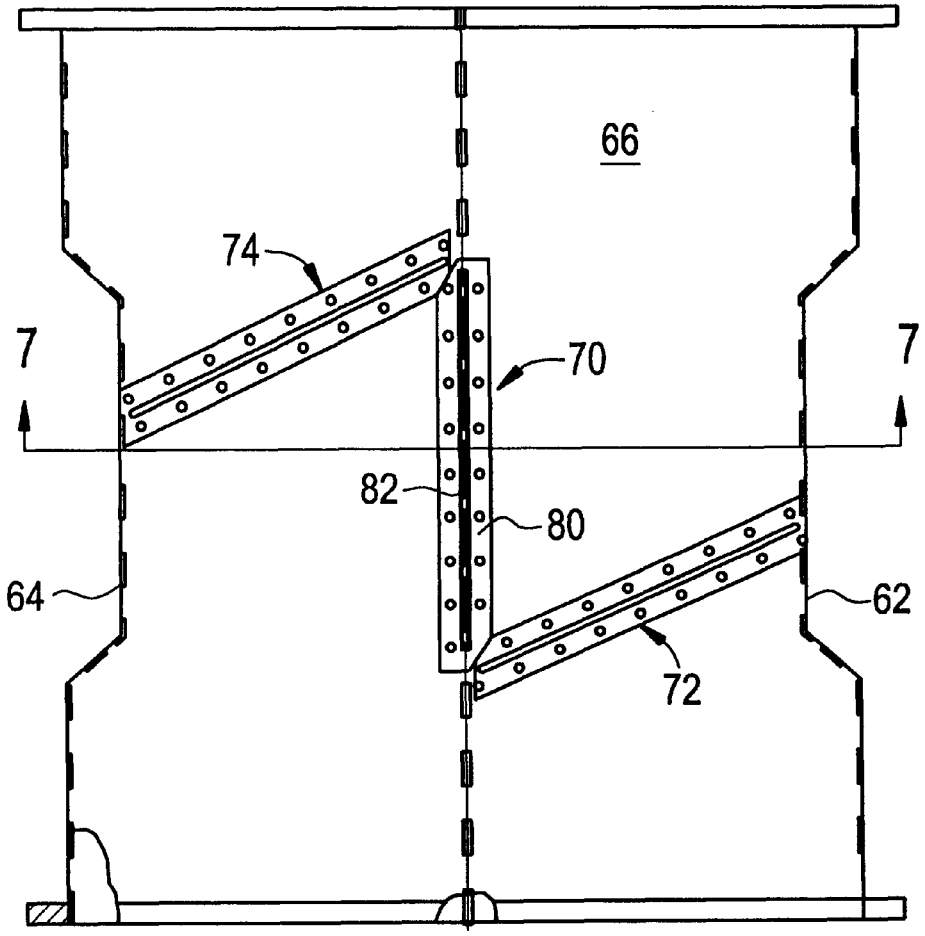
FIG. 5 is a plan view of the directional coupler of FIG. 1.
Figure 6:
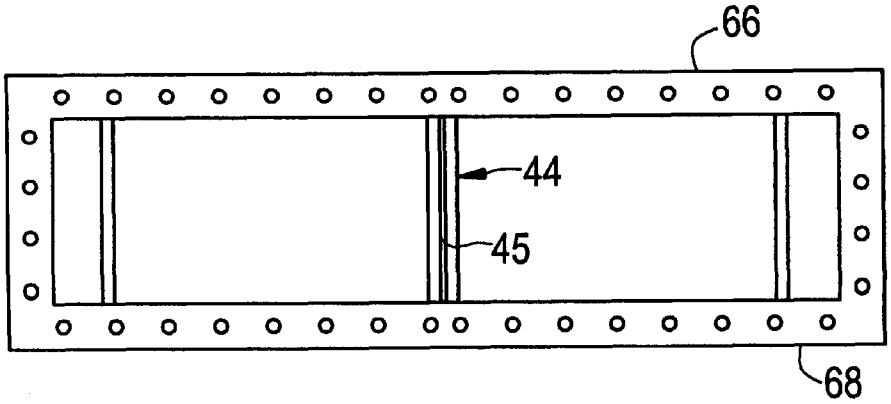
FIG. 6 is a side view of FIG. 5.
Figure 7:
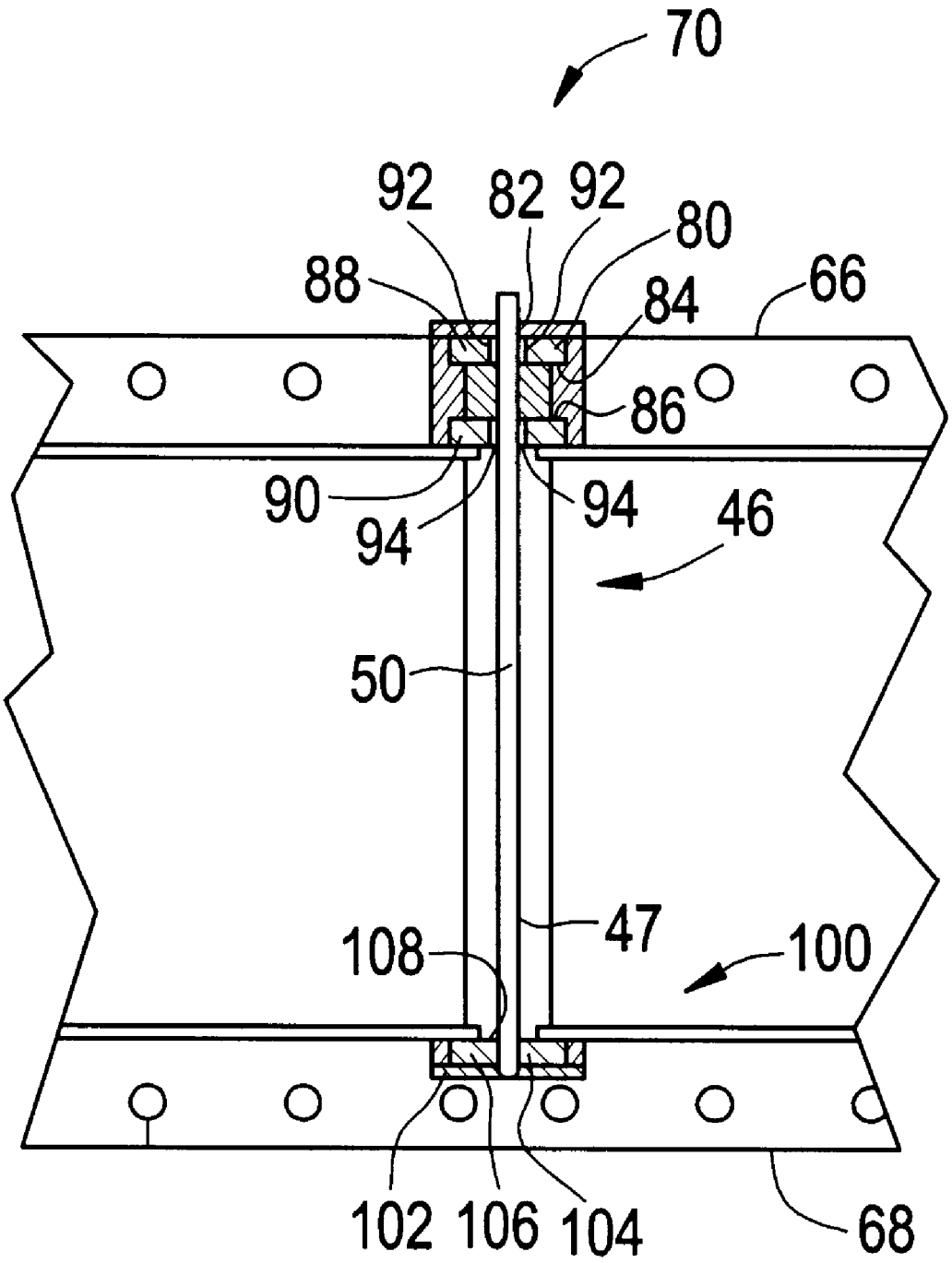
FIG. 7 is a view taken along line 7—7 of FIG. 5.

Referring to FIGS. 5 through 7, enclosure 40 is generally rectangular with sidewalls 62 and 64, a top wall 66 and a bottom wall 68. Panels 44 and 46 are formed with a channel or groove to facilitate the slidable insertion and removal of shutter 50. Thus, panel 44 has a channel 45 as shown in FIG. 6 and panel 46 has a channel 47 as shown in FIG. 7. Similar channels (not shown) are formed in panel 44 and side wall 62 to facilitate the insertion and removal of shutter 56 and in panel 46 and sidewall 64 to facilitate the insertion and removal of shutter 58.

A set of shutter slots 70, 72 and 74 are disposed in top wall 66 for the insertion and removal of shutters 50, 56, and 58, respectively. As shutter slots 70, 72 and 74 have similar structures, only shutter slot 70 will be described in detail.

Referring to FIG. 7, shutter slot 70 includes an elongated metallic frame 80 with a slot 82 disposed lengthwise therein for insertion and removal of shutter 50. Elongated frame 80 has an upper shelf 84 and a lower shelf 86. An upper metallic member 88 rests upon upper shelf 84 and extends toward slot 82. A lower metallic member 90 rests on lower shelf 86 and extends toward slot 82. A pair of metallic spring fingers 92 is disposed on the end of upper member 88 so as to engage and maintain good electrical contact with shutter 50. A pair of metallic spring fingers 94 is disposed on the end of lower metallic member 90 so as to engage and maintain good electrical contact with shutter 50. Elongated frame 80, upper member 88 and lower metallic member 90 support an elongated shelf 84 that surrounds slot 82 to provide a low friction sliding surface for shutter 50. For example, shelf 84 may suitably be formed of a polymer, such as, polytetrafluoroethylene.

A channel 100 is located in bottom wall 68 directly opposite shutter slot 70. Channel 100 includes an elongated metallic frame 102 with a groove 104. A metallic member 106 is located within groove 104 and has a geometry that forms a slot 108 that is in registry with slot 82 of shutter slot 70. A pair of metallic spring fingers 110 is disposed on the end of member 106 that faces slot 108 so as to engage and make electrical contact with shutter 50.

Figure 9:
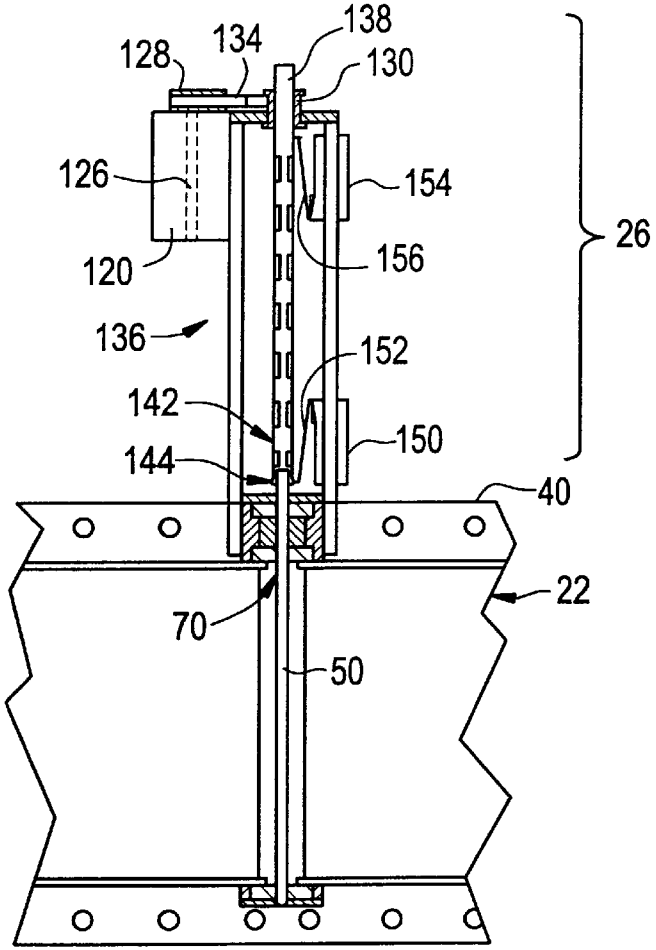
FIG. 9 is a view taken along line 9—9 of FIG. 8.
Figure 8:
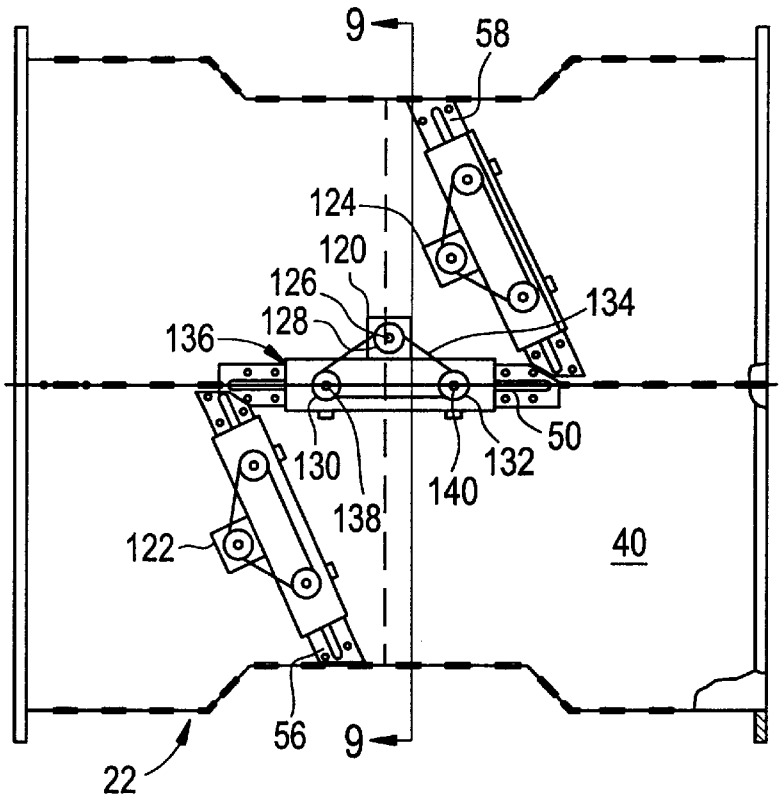
FIG. 8 is plan view of the directional coupler of FIG. 1 with drive motors.

Referring to FIGS. 8 and 9, the control mechanism 26, as shown in FIG. 1, which is usable to control the directional coupler 22, includes a motor 120 that is interconnected with shutter 50, a motor 122 that is interconnected with shutter 56 and a motor 124 that is interconnected with shutter 58. As motors 120, 122 and 124 and their associated interconnections are substantially similar, only motor 120 and its interconnection with shutter 50 will be described in detail.

Motor 120 has a shaft 126 that is coupled to a pulley 128 that is connected in driving relation by a belt 134 to a pair of pulleys 130 and 132. Motor 120 and pulleys 130 and 132 are mounted to a frame 136 that in turn is mounted to enclosure 40 in registry with shutter slot 70 (FIG. 9). Pulleys 130 and 132 are mounted on lead screws 138 and 140, respectively. Lead screw shafts 138 and 140 are interconnected with shutter 50 at spaced apart locations to lower shutter 50 into and lift shutter 50 out of directional coupler 22 when powered by motor 120. As lead screw shafts 138 and 140 are substantially similar, only lead screw shaft 138 will be described in detail.

Referring to FIG. 9, lead screw 138 has its lower end 142 secured to shutter 50. Lower end 142 has a protrusion, shown as an annular bulbous 144. As motor 120 and pulley 128 rotate in a first direction, belt 134 drives pulleys 130 and 132 (not shown) to rotate in a direction that drives lead screws 138 and 140 (not shown) downwardly to lower shutter 50 into directional coupler 22 to the position shown in FIG. 9. As motor 120 rotates in the opposite direction, lead screws 138 and 140 (not shown) are driven upwardly out of frame 136 to lift shutter 50 out of directional coupler 22. A micro switch 150 is positioned near the bottom of frame 136 and has a switch lever 152 that is tripped by bulbous 144 when shutter 50 has been fully lowered into directional coupler 22. Another micro switch 154 is positioned near the top of frame 136 and has a switch lever 156 that is tripped by bulbous 144 when shutter 50 has been fully lifted out of directional coupler 22. When either switch lever 152 or switch lever 156 is tripped, motor 120 is turned off.

Figure 10:
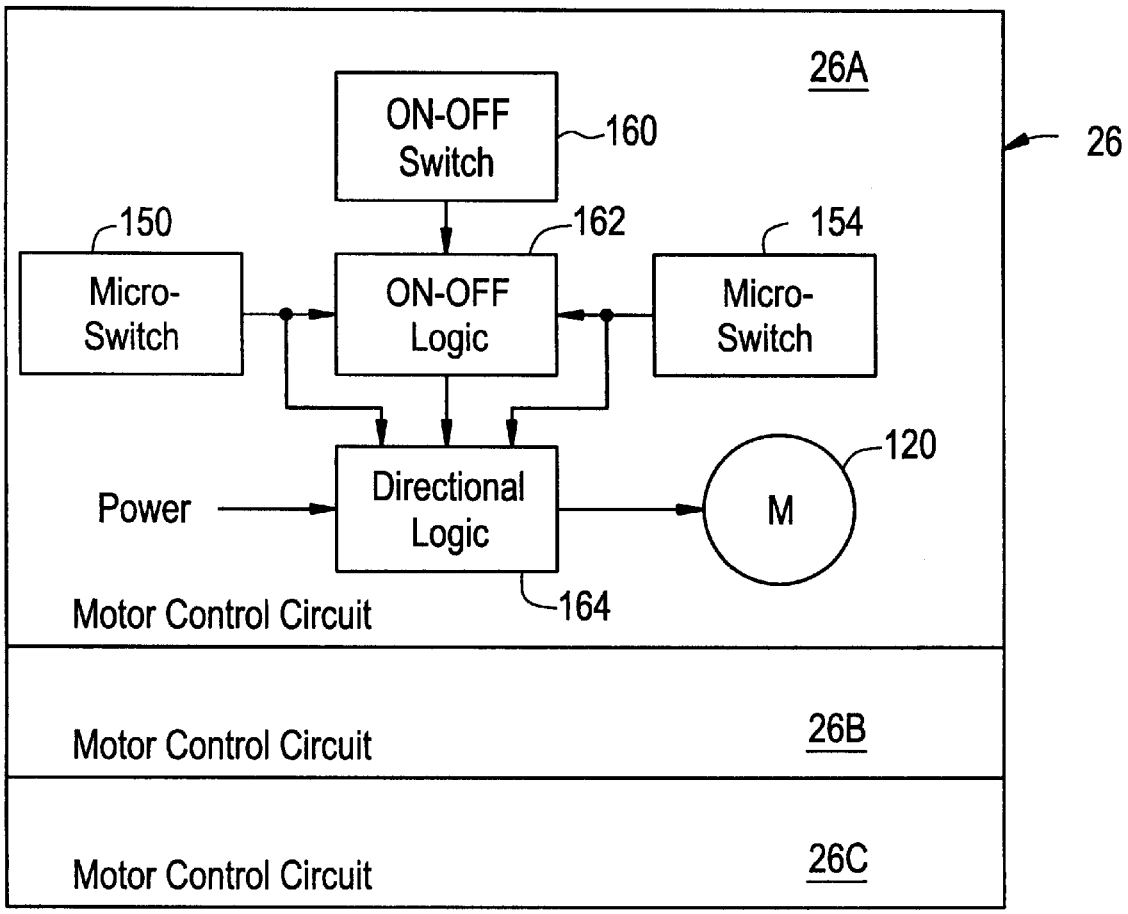
FIG. 10 is block diagram of the control mechanism of the directional coupler of FIG. 1.

Referring to FIG. 10, control mechanism 26 includes a control circuit 26A for motor 120, a motor control circuit 26*b* for motor 122 and a motor control circuit 26C for motor 124. As motor control circuits 26A, 26B and 26C are substantially identical, only motor control circuit 26A will be described in detail.

Motor control circuit 26a includes an ON-OFF switch 160, an ON-OFF logic 162, a directional logic 164 and micro switches 150 and 154. ON-OFF switch 160 may suitably be a manually operated toggle switch that serves to turn motor 120 on or off. For example, ON-OFF switch 160, when toggled with motor 120 turned off, provides a signal signifying that motor 120 is to be turned on to directional logic 164. Directional logic 164 responds to this signal to supply operating power to motor 120 to rotate motor 120 in a direction that is determined by the tripping of micro switches 150 and 154. Thus, if micro switch 150 was last tripped, motor 120 is rotated in a direction to lift shutter 50 out of directional coupler 22. On the other hand, if micro switch 154 was last tripped, motor 120 is rotated in a direction to lower shutter 50 into directional coupler 22.

The present invention having been thus described with particular reference to the preferred forms thereof, it will be obvious that various changes and modifications may be made therein without departing from the spirit and scope of the present invention as defined in the appended claims.

What is claimed is:

1. A directional coupler comprising:

an electrical signal coupling enclosure having first, second, third and fourth ports, the fourth port providing an output signal when a load is connected to the third port in response to input signals applied to either or both of the first and second ports; and a switch having a first position that partitions the enclosure so that the output signal has an amplitude of A+B when first and second ones of the input signals with amplitudes A and B are applied to the first and second ports, respectively, said switch having a second position that partitions the enclosure so that the output signal has an amplitude of A when only the first input signal is applied to the first port, and said switch having a third position that partitions the enclosure so that the output signal has an amplitude of B when only the second input signal is applied to the second port.

2. The directional coupler of claim 1, wherein the enclosure is a waveguide.

3. The directional coupler of claim 1, wherein said switch includes one or more shutters that are located to establish the first, second and third positions within the signal coupling enclosure.

4. The directional coupler of claim 1, wherein the first position of the switch provides signal coupling among the first, second, third and fourth ports, the second position of the switch isolates the second and third ports to thereby allow coupling between the first and fourth ports, and the third position of the switch isolates the first and third ports to thereby allow coupling between the second and fourth ports.

5. The directional coupler of claim 4, wherein the switch includes a first shutter that is operable to place the switch in the first and third positions.

6. The directional coupler of claim 5, wherein the switch further includes second and third shutters that are operable to place the switch in the second position.

7. The directional coupler of claim 6, wherein said coupling enclosure has channels in which the first, second and third shutters are slidable to establish the first, second and third positions.

8. The directional coupler of claim 7, further comprising a control mechanism for moving the first, second and third shutters to establish the first, second and third positions.

9. The directional coupler of claim 8, wherein the switch control includes one or more motors for moving the first, second and third shutters in the channels.

10. A method of coupling signals among first, second, third and fourth ports of a directional coupler, the fourth port providing an output signal in response to input signals applied to either or both of the first and second ports when the third port is connected to a load, said method comprising:

(a) partitioning the directional coupler so that the output signal has an amplitude of A+B when first and second ones of the input signals with amplitudes A and B are applied to the first and second ports, respectively;

(b) partitioning the directional coupler so that the output signal has an amplitude of A when only the first input signal is applied to the first port; and (c) partitioning the directional coupler so that the output signal has an amplitude of B when only the second input signal is applied to the second port.

11. The method of claim 10, wherein step (a) provides signal coupling among the first, second, third and fourth ports, wherein step (b) isolates the second and third ports to thereby allow coupling between the first and fourth ports, and wherein step (c) isolates the first and third ports to thereby allow coupling between the second and fourth ports.

* * * * *